US008816577B2

(12) United States Patent
Ma et al.

(10) Patent No.: US 8,816,577 B2
(45) **Date of Patent: *Aug. 26, 2014**

(54) SPARK PLUG INCLUDING ELECTRODES WITH LOW SWELLING RATE AND HIGH CORROSION RESISTANCE

(75) Inventors: Shuwei Ma, Ann Arbor, MI (US); James D. Lykowski, Temperance, MI (US)

(73) Assignee: Federal-Mogul Ignition Company, Southfield, MI (US)

( * ) Notice: Subject to any disclaimer, the term of this patent is extended or adjusted under 35 U.S.C. 154(b) by 36 days.

This patent is subject to a terminal disclaimer.

(21) Appl. No.: 13/617,237

(22) Filed: Sep. 14, 2012

(65) Prior Publication Data

US 2013/0063017 A1 Mar. 14, 2013

Related U.S. Application Data

(62) Division of application No. 12/855,229, filed on Aug. 12, 2010, now Pat. No. 8,288,927.

(60) Provisional application No. 61/233,323, filed on Aug. 12, 2009.

(51) Int. Cl.

| | |
|---|---|
| ***H01T 13/00*** | (2006.01) |
| ***H01T 13/39*** | (2006.01) |
| ***H01T 13/38*** | (2006.01) |
| *H01T 13/32* | (2006.01) |

(52) U.S. Cl.

CPC ..... *H01T 13/38* (2013.01); *H01T 13/39* (2013.01); *H01T 13/32* (2013.01)

USPC ..... 313/118; 313/141

(58) Field of Classification Search

None

See application file for complete search history.

(56) References Cited

U.S. PATENT DOCUMENTS

| | | | |
|---|---|---|---|
| 4,949,006 | A | 8/1990 | Oshima |
| 5,395,273 | A | 3/1995 | Matsutani |
| 5,497,045 | A | 3/1996 | Matsutani |
| 5,578,894 | A | 11/1996 | Oshima |
| 5,578,895 | A | 11/1996 | Oshima |

(Continued)

FOREIGN PATENT DOCUMENTS

| | | |
|---|---|---|
| JP | 61143973 | 7/1986 |
| JP | 10251787 | 9/1998 |

OTHER PUBLICATIONS

Third Party Observation, European Patent Application 10808745.3 mailed Mar. 22, 2013.

*Primary Examiner* — Natalie Walford

(74) *Attorney, Agent, or Firm* — Robert L. Stearns; Dickinson Wright, PLLC

(57) ABSTRACT

A spark plug (20) includes a center electrode (24) and a ground electrode (22). The electrodes (22, 24) include a core (26) formed of a copper (Cu) alloy and a clad (28) formed of a nickel (Ni) alloy enrobing the core (26). The Cu alloy includes Cu in an amount of at least 98.5 weight percent, and at least one of Zr and Cr in an amount of at least 0.05 weight percent. The Cu alloy includes a matrix of the Cu and precipitates of the Zr and Cu dispersed in the Cu matrix. The Ni alloy of the clad (28) includes Ni in an amount of at least 90.0 weight percent. The Ni alloy also includes at least one of a Group 3 element, a Group 4 element, a Group 13 element, chromium (Cr), silicon (Si), and manganese (Mn) in a total amount sufficient to affect the strength of the Ni alloy.

19 Claims, 4 Drawing Sheets

(56) References Cited

U.S. PATENT DOCUMENTS

| | | | |
|---|---|---|---|
| 6,677,698 | B2 | 1/2004 | Labarge et al. |
| 6,759,795 | B2 | 7/2004 | Kumagai et al. |
| 7,150,252 | B2 | 12/2006 | Sugiyama et al. |
| 2004/0078971 | A1 | 4/2004 | Muranaka et al. |
| 2004/0080252 | A1 | 4/2004 | Ito et al. |
| 2005/0023949 | A1 | 2/2005 | Hori |
| 2006/0082276 | A1 | 4/2006 | Havard et al. |
| 2007/0290591 | A1 | 12/2007 | Lykowski et al. |
| 2007/0290593 | A1 | 12/2007 | Kowalski |
| 2008/0030116 | A1 | 2/2008 | Joseph et al. |
| 2008/0308057 | A1 | 12/2008 | Lykowski et al. |
| 2009/0051259 | A1 | 2/2009 | Yoshimoto |
| 2009/0107440 | A1 | 4/2009 | Lykowski et al. |
| 2009/0189502 | A1 | 7/2009 | Suzuki et al. |

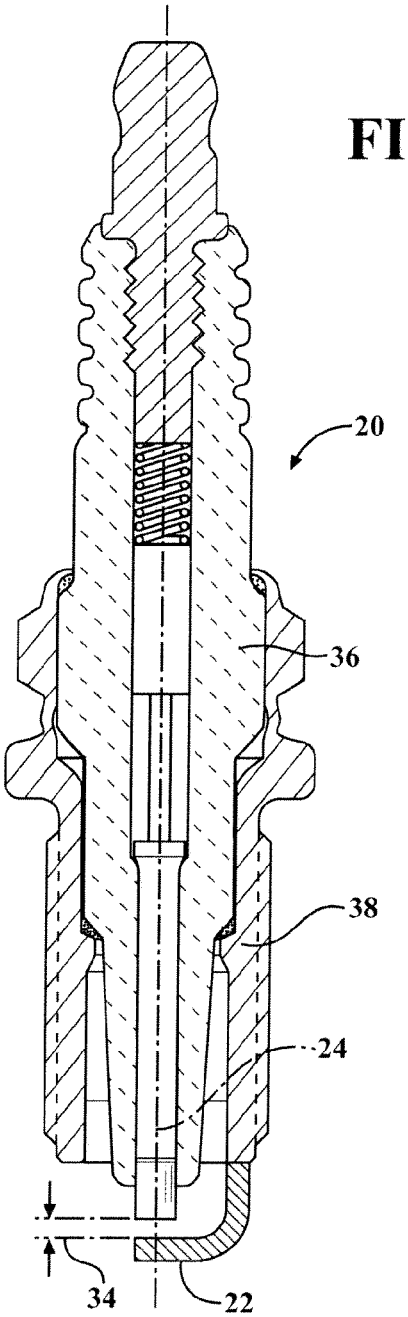
FIG. 1
FIG. 2
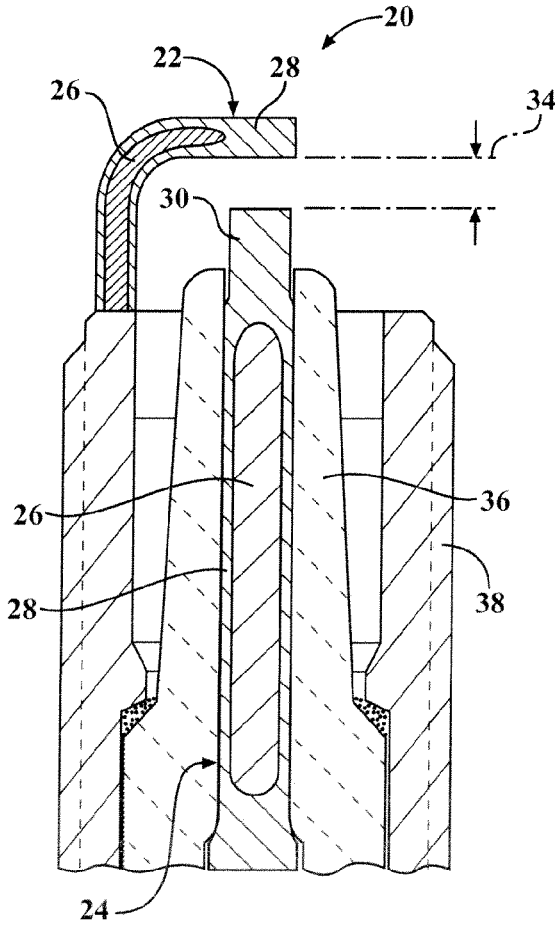

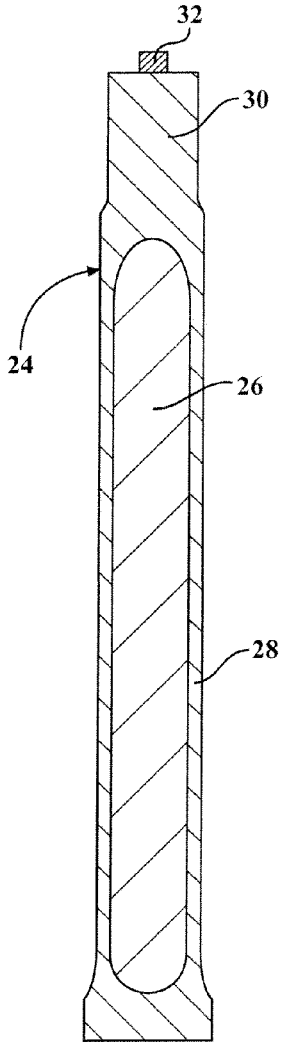
FIG. 3
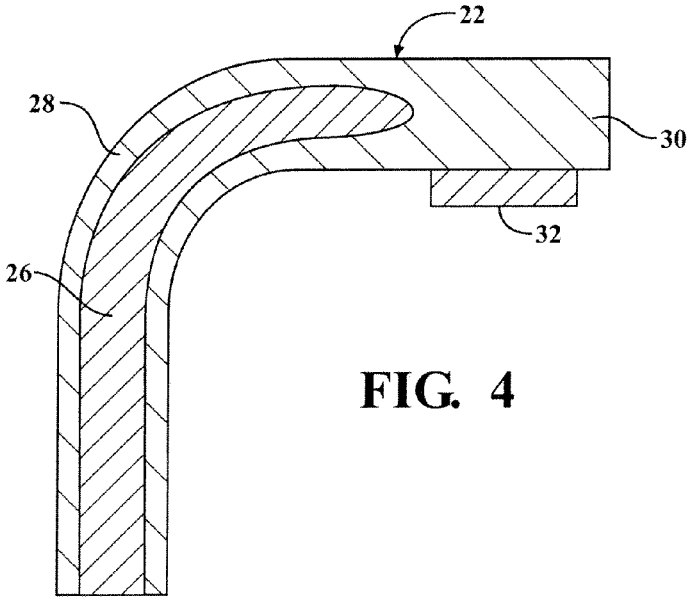
FIG. 4
FIG. 9
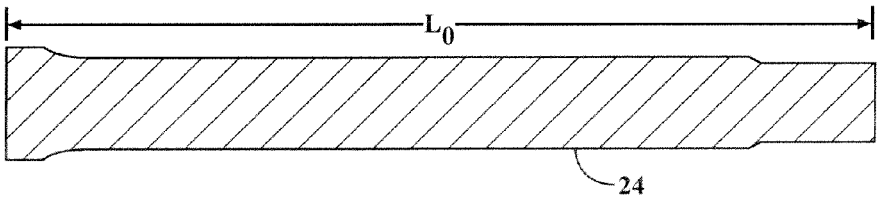

SPARK PLUG INCLUDING ELECTRODES WITH LOW SWELLING RATE AND HIGH CORROSION RESISTANCE

CROSS REFERENCE TO RELATED APPLICATION

This divisional application claims the benefit of application Ser. No. 12/855,229, filed Sep. 19, 2012, now U.S. Pat. No. 8,288,927, which claims priority to application Ser. No. 61/233,323 filed Aug. 12, 2009 and is incorporated herein by reference.

BACKGROUND OF THE INVENTION

1. Field of the Invention

This invention relates generally to materials for spark plug electrodes, and particularly to materials of the electrodes.

2. Description of the Prior Art

Spark plugs are widely used to initiate combustion in an internal combustion engine. Spark plugs typically include a ceramic insulator, a conductive shell surrounding the ceramic insulator, a center electrode disposed in the ceramic insulator, and a ground electrode operatively attached to the conductive shell. The electrodes each have a sparking end located proximate one another and defining a spark gap therebetween. Such spark plugs ignite gases in an engine cylinder by emitting an electrical spark jumping the spark gap between the center electrode and ground electrode, the ignition of which creates a power stroke in the engine. Due to the nature of internal combustion engines, spark plugs operate in an extreme environment of high temperature and various corrosive combustion gases and therefore should be fabricated of appropriate materials. When the electrodes are not fabricated of appropriate materials, the extreme working conditions may gradually increase the width of the spark gap between the center electrode and ground electrode, and may induce the misfire of spark plugs and cause subsequent loss of engine power and performance.

Spark plug electrodes often include a core formed of copper (Cu) and a clad formed of a nickel (Ni) alloy due to the high temperature performance of Cu and Ni. Ni alloys are resistant to erosion and corrosion, and Cu provides a high thermal conductivity and thus a controlled operating temperature of the electrode. An example of an existing electrode includes a core formed of 100 wt % Cu and a clad formed of a Ni alloy including 14.5-15.5 wt % Cr, 7.0-8.0 wt % Fe, 0.2-0.5 wt % Mn, and 0.2-0.5 wt % Si and a balance of Ni.

The existing electrodes including a Cu core and Ni alloy clad experience large temperature gradients when the engine runs between full throttle and idle operation. There is a significant difference in thermal expansion of the Cu core and the Ni clad, which causes undesirable swelling and thermal mechanical stresses. The swelling may increase the width of the spark gap unexpectedly. At high temperatures, such as greater than 500° C., compressive axial thermal stress builds up in the Cu core due to the higher thermal expansion coefficient of Cu than that of Ni. The Cu can undergo a time dependent creep deformation under the compressive axial stress. The Cu core shrinks axially and expands radially, which compresses the Ni clad. The Ni clad has a tension stress along the azimuthal direction which may cause cracking in the Ni clad and insulator. FIGS. 5 and 6 show deformation of the electrode and cracks due to thermal stress and creep, which may hinder the performance of the spark plug.

SUMMARY OF THE INVENTION AND ADVANTAGES

One aspect of the invention provides a spark plug comprising a center electrode and a ground electrode, at least one of the electrodes including a core formed of a copper (Cu) alloy and a clad formed of a nickel (Ni) alloy covering the core. The Cu alloy includes, in weight percent of the Cu alloy, Cu in an amount of at least 95.0 weight percent and at least one of Zr and Cr in a total amount sufficient to affect the strength of the Cu alloy. The Ni alloy of the clad includes, in weight percent of the Ni alloy, Ni in an amount of at least 90.0 weight percent and at least one of a Group 3 element, a Group 4 element, a Group 13 element, chromium (Cr), silicon (Si), and manganese (Mn) in a total amount sufficient to affect the strength of the Ni alloy.

Another aspect of the invention provides an electrode for use in a spark plug comprising a core formed of a copper (Cu) alloy and a clad formed of a nickel (Ni) alloy covering the core. The Cu alloy includes, in weight percent of the Cu alloy, Cu in an amount of at least 95.0 weight percent and at least one of Zr and Cr in a total amount sufficient to affect the strength of the Cu alloy. The Ni alloy of the clad includes, in weight percent of the Ni alloy, Ni in an amount of at least 90.0 weight percent and at least one of a Group 3 element, a Group 4 element, a Group 13 element, chromium (Cr), silicon (Si), and manganese (Mn) in a total amount sufficient to affect the strength of the Ni alloy.

Yet another aspect of the invention provides a method of forming a spark plug having at least one electrode, comprising the steps of providing a first powder metal material including Cu and at least one of Zr and Cr; and heating the first powder metal material to provide a Cu alloy including, in weight percent of the Cu alloy, Cu in an amount of at least 98.50 weight percent and at least one of Zr and Cr in a total amount sufficient to affect the strength of the Cu alloy, and forming the Cu alloy into a core. The method also includes providing a second powder metal material including Ni and at least one of a Group 3 element, a Group 4 element, a Group 13 element, chromium (Cr), silicon (Si), and manganese (Mn); and heating the second powder metal material to provide a Ni alloy including, in weight percent of the Ni alloy, Ni in an amount of at least 90.0 weight percent and at least one of a Group 3 element, a Group 4 element, a Group 13 element, chromium (Cr), silicon (Si), and manganese (Mn) in a total amount sufficient to affect the strength of the Ni alloy, and forming the Ni alloy into a clad covering the core.

The combination of the Cu alloy and the Ni alloy of the inventive electrodes and spark plugs provides both high thermal conductivity and reduced swelling rate, compared to the prior art electrodes and spark plugs. The inventive electrodes and spark plugs provide oxidation, erosion, and corrosion resistance; adequate operating temperatures; improved creep resistance; and reduced cracking, compared to the prior art electrodes and spark plugs. Thus, spark plugs of the present invention, including the Cu alloy and Ni alloy, provide improved performance during operation than the prior art spark plugs.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 1 is a longitudinal sectional view of a spark plug according to a first embodiment of the invention;

FIG. 2 is a longitudinal cross sectional view of a portion of the spark plug of FIG. 1;

FIG. 3 is a longitudinal cross sectional view of a center electrode according to a second embodiment of the invention;

FIG. 4 is a longitudinal cross sectional view of a ground electrode according to a third embodiment of the invention;

FIG. 9 illustrates the length of an electrode measured before an engine test.

DETAILED DESCRIPTION OF THE INVENTION

Figure 5:
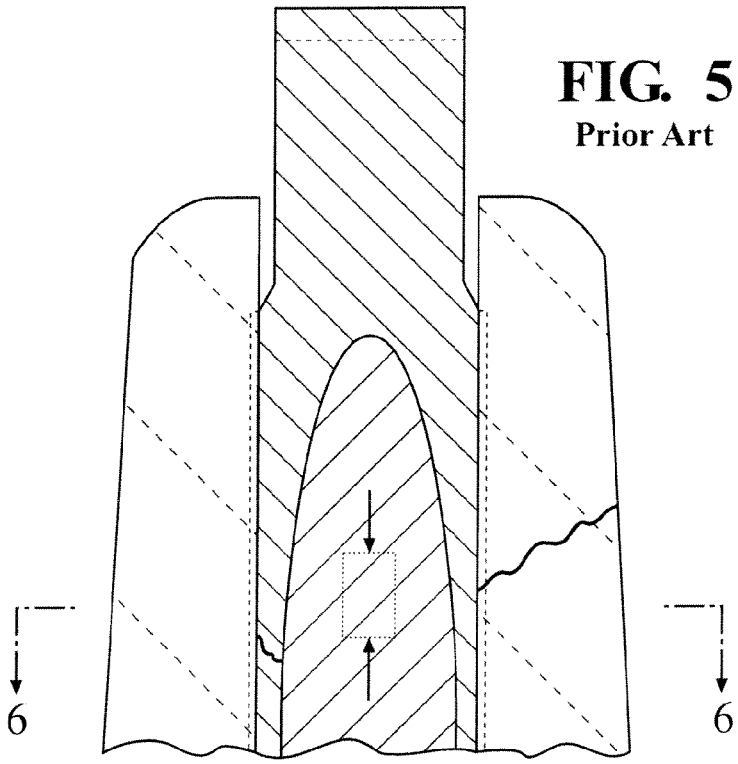
FIG. 5 Prior Art
FIG. 5 is a sectional view of a portion of a spark plug of the prior art showing a swelling mechanism due to thermal stress in the center electrode.
Figure 6:
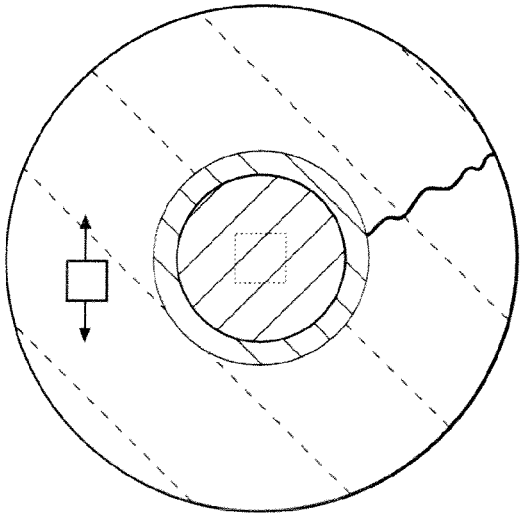
FIG. 6 Prior Art
FIG. 6 is a transversal cross section view of a center electrode of the prior art showing a crack formed in the Ni clad due to swelling of the center electrode.

Referring to FIGS. 1 and 2, a spark plug 20 including a ground electrode 22 and a center electrode 24 are shown. As shown in FIG. 2, the electrodes 22, 24 each include a core 26 formed of a Cu alloy and a clad 28 formed of a Ni alloy covering the core 26. The composition of the Cu alloy provides high thermal conductivity and thus erosion and oxidation resistance and adequate operating temperature of the electrodes 22, 24. The Cu alloy also provides improved creep resistance, reduced swelling, and reduced cracking, compared to Cu alloys of the prior art electrodes 22, 24. The composition of the Ni alloy provides also provides high thermal conductivity and thus erosion resistant, oxidation resistance, and adequate operating temperature. The combination of the core 26 formed of the Cu alloy and the clad 28 formed of the Ni alloy provides electrodes 22, 24 with both high erosion resistance and reduced swelling and cracking. The electrodes 22, 24 allow the spark plug 20 to provide improved performance during operation in an internal combustion engine, compared to spark plugs of the prior art.

As stated above, the core 26 of the electrodes 22, 24 are formed of a Cu alloy. The Cu alloy includes Cu in an amount sufficient to affect the thermal conductivity of the Cu alloy. In one embodiment, the Cu alloy has a thermal conductivity of at least 320 W/mK. In another embodiment, the Cu alloy has a thermal conductivity of at least 330 W/mK. In yet another embodiment, the Cu alloy has a thermal conductivity of 320 W/mK to 360 W/mK. The Cu alloy has a high thermal conductivity and thus provides a low operating temperature which allows the spark plug 20 to maintain excellent performance at temperatures greater than 500° C.

The Cu alloy also includes at least one of Zr and Cr in a total amount sufficient to affect the strength of the Cu alloy. The Zr and Cr have a low solubility in Cu. Thus, a relatively low amount of the Zr and Cr in the Cu may form a saturated or supersaturated solution. Upon heating, the Zr and Cr precipitate from the Cu and strengthen the Cu alloy. In other words, the Cu alloy includes a matrix of Cu and precipitates of Zr and Cr dispersed in the Cu matrix. The Zr and Cr precipitates strengthen the Cu alloy. The high strength of the Cu alloy improves creep resistance and reduces swelling of the Cu alloy during operation of the spark plug 20. Table 1 shows the solubility of Zr and Cr in Cu, in weight percent of the Cu alloy, at a room temperature of 19.85° C. The solubility of the element, such as the Zr or Cr, is the amount of the element, in weight percent of the Cu alloy, that can dissolve in the Cu matrix to yield a saturated or supersaturated solution.

TABLE 1

| | Element | | | | | | | | | | |
|---|---|---|---|---|---|---|---|---|---|---|---|
| | Cr | Zr | Te | Se | S | Fe | Ag | B | Be | P | Ti |
| Solubility | 0.03 | <0.01 | <0.005 | <0.002 | <0.0025 | 0.14 | 0.1 | 0.06 | 0.2 | 0.5 | 0.4 |

The Cu and at least of Zr and Cr are provided and then heated, preferably sintered, to provide the Cu alloy. The Cu, Zr, and Cr are typically provided in the form of powder metal. In one embodiment, the Cu alloy includes Cu in an amount of 98.50 weight percent to 99.95. In another embodiment, the Cu alloy includes Cu in an amount of 98.70 weight percent to 99.92 weight percent. In yet another embodiment, the Cu alloy includes the Cu in an amount of 99.75 weight percent to 99.85 weight percent. The weight percent of Cu in the Cu alloy is determined by dividing the mass of Cu in the Cu alloy by the total mass of the Cu alloy. The presence and amount of the Cu of the Cu alloy may be detected by a chemical analysis or by viewing an Energy Dispersive Spectra (E.D.S.) of the core 26 after heating or sintering. The E.D.S. may be generated by a Scanning Electron Microscopy (S.E.M.) instrument.

In one embodiment, the Cu alloy includes Cu in an amount of at least 98.50 weight percent. In another embodiment, the Cu alloy includes Cu in an amount of at least 98.59 weight percent. In yet another embodiment, the Cu alloy includes the Cu in an amount of at least 98.70 weight percent.

In one embodiment, the Cu alloy includes Cu in an amount of at less than 99.95 weight percent. In another embodiment, the Cu alloy includes Cu in an amount less than 99.91 weight percent. In yet another embodiment, the Cu alloy includes the Cu in an amount less than 99.78 weight percent.

As stated above, the Cu alloy includes at least one of Zr and Cr in a total amount sufficient to affect the strength of the Cu alloy. In one embodiment, the Cu alloy includes the at least one of Zr and Cr in a total amount of 0.05 weight percent to 1.5 weight percent. In another embodiment, the Cu alloy includes the at least one of Zr and Cr in a total amount of 0.13 weight percent to 1.3 weight percent. In yet another embodiment, the Cu alloy includes the at least one of Zr and Cr in a total amount of 0.5 weight percent to 1.0 weight percent. The total amount of the Zr and Cr, in weight percent of the Cu alloy, is determined by adding the mass of the Zr and Cr and dividing the sum by the total mass of the Cu alloy. The presence and amount of the Zr and Cr in the Cu alloy may be detected by a chemical analysis or by viewing an Energy Dispersive Spectra (E.D.S.) of the core 26 after heating or sintering. The E.D.S. may be generated by a Scanning Electron Microscopy (S.E.M.) instrument.

In one embodiment, the Cu alloy includes at least one of Zr and Cr in a total amount of at least 0.05 weight percent. In another embodiment, the Cu alloy includes at least one of Zr and Cr in a total amount of at least 0.09 weight percent. In yet another embodiment, the Cu alloy includes at least one of Zr and Cr in a total amount of at least 0.8 weight percent.

In one embodiment, the Cu alloy includes at least one of Zr and Cr in a total amount of less than 1.5 weight percent. In another embodiment, the Cu alloy includes at least one of Zr and Cr in a total amount of less than 1.3 weight percent. In yet another embodiment, the Cu alloy includes at least one of Zr and Cr in a total amount of less than 1.0 weight percent.

In one embodiment, the Cu alloy includes Zr and does not include Cr. In another embodiment, the Cu alloy includes Cr and does not include Zr. In yet another embodiment, the Cu alloy includes both Cr and Zr.

The Cu alloy of the core 26 may also include at least one solubility resistant element in a total amount sufficient to affect the strength of the Cu alloy. The solubility resistant elements include tellurium (Te), selenium (Se), iron (Fe), silver (Ag), boron (B), beryllium (Be), phosphorus (P), titanium (Ti), and sulfur (S). The solubility resistant elements have a low solubility in Cu. Thus, a relatively low amount of the solubility resistant elements in the Cu may form a saturated or supersaturated solution. Upon heating, the solubility resistant elements precipitate from the Cu and strengthen the Cu alloy, along with the Cr and Zr. In other words, the Cu alloy includes a matrix of Cu and precipitates of the solubility resistant elements, Te, Se, Fe, Ag, B, Be, P, Ti, and S dispersed in the Cu matrix. Table 1 above shows the solubility of the solubility resistant elements in Cu. The high strength of the Cu alloy improves creep resistance and reduces the swelling rate of the Cu alloy during operation of the spark plug 20 at temperatures greater than 500° C.

The solubility resistant elements, including at least one of Te, Se, Fe, Ag, B, Be, P, Ti, and S, are provided along with the Cu, Zr, and Cr, and then heated, preferably sintered, to provide the Cu alloy. The solubility resistant elements are also typically provided in the form of powder metal. The weight percent of the Te, Se, Fe, Ag, B, Be, P, Ti, and S of the Cu alloy is determined by adding the masses of the Te, Se, Fe, Ag, B, Be, P, Ti, and S and dividing the sum by the total mass of the Cu alloy. The presence and amount of the Te, Se, Fe, Ag, B, Be, P, Ti, and S of the Cu alloy may be detected by a chemical analysis or by viewing an Energy Dispersive Spectra (E.D.S.) of the core 26 after heating or sintering. The E.D.S. may be generated by a Scanning Electron Microscopy (S.E.M.) instrument.

In one embodiment, the total amount of the Zr, Cr, and solubility resistant elements is less than 1.5 weight percent. In another embodiment, the Zr, Cr, and solubility resistant elements is less than 1.3 weight percent. In yet another embodiment, the Zr, Cr, and solubility resistant elements is less than 0.9 weight percent.

In one embodiment, the Cu alloy includes the at least one of Te, Se, Fe, Ag, B, Be, P, Ti, and S of the Cu alloy in a total amount of 0.01 weight percent to 1.45 weight percent. In another embodiment, the Cu alloy includes the at least one of Te, Sc, Fe, Ag, B, Be, P, Ti, and S in a total amount of 0.05 weight percent to 1.40 weight percent. In yet another embodiment, the Cu alloy includes the at least one of Te, Se, Fe, Ag, B, Be, P, Ti, and S in a total amount of 0.1 weight percent to 0.9 weight percent.

In one embodiment, the Cu alloy includes the at least one of Te, Se, Fe, Ag, B, Be, P, Ti, and S of the Cu alloy in a total amount of at least 0.001 weight percent. In another embodiment, the Cu alloy includes the at least one of Te, Se, Fe, Ag, B, Be, P, Ti, and S in a total amount of at least 0.2 weight percent. In yet another embodiment, the Cu alloy includes the at least one of Te, Se, Fe, Ag, B, Be, P, Ti, and S in a total amount of at least 0.3 weight percent.

In one embodiment, the Cu alloy includes at least one of Te, Se, Fe, Ag, B, Be, P, Ti, and S of the Cu alloy in a total amount of less than 1.45 weight percent. In another embodiment, the Cu alloy includes at least one of Te, Se, Fe, Ag, B, Be, P, Ti, and S in a total amount less than 1.0 weight percent. In yet another embodiment, the Cu alloy includes at least one of Te, Se, Fe, Ag, B, Be, P, Ti, and S in a total amount less than 0.7 weight percent.

As stated above, the electrodes 22, 24 also include the clad 28 formed of the Ni alloy covering the core 26. The Ni alloy includes Ni in an amount sufficient to affect the thermal conductivity of the Ni alloy. The Ni alloy has a high thermal conductivity and thus provides a low operating temperature and high resistance to oxidation and erosion, which allows the spark plug 20 to maintain excellent performance at temperatures greater than 500° C. In one embodiment, the Ni alloy has a thermal conductivity of at least 25 W/mK. In another embodiment, the Ni alloy has a thermal conductivity of at least 35 W/mK. In yet another embodiment, the Ni alloy has a thermal conductivity of 25 W/mK to 100 W/mK. The Ni alloy also includes at least one of a Group 3 element, a Group 4 element, a Group 13 element, chromium (Cr), silicon (Si), and manganese (Mn) in a total amount sufficient to strengthen the Ni alloy. The Ni and the at least one of a Group 3 element, a Group 4 element, a Group 13 element, chromium (Cr), silicon (Si), and manganese (Mn) are provided and then heated, preferably sintered, to form the Ni alloy.

In one embodiment, the Ni alloy includes Ni in an amount of 90.0 weight percent to 99.99 weight percent. In another embodiment, the Ni alloy includes Ni in an amount of 91.0 weight percent to 99.92 weight percent. In yet another embodiment, the Ni alloy includes Ni in an amount of 92.5 weight percent to 97.0 weight percent. The weight percent of the Ni of the Ni alloy is determined by dividing the mass of the Ni by the total mass of the Ni alloy. The presence and amount of the Ni of the Ni alloy may be detected by a chemical analysis or by viewing an Energy Dispersive Spectra (E.D.S.) of the clad 28 after heating or sintering. The E.D.S. may be generated by a Scanning Electron Microscopy (S.E.M.) instrument.

In one embodiment, the Ni alloy includes Ni in an amount of at least 90.0 weight percent. In another embodiment, the Ni alloy includes Ni in an amount of at least 91.0 weight percent. In yet another embodiment, the Ni alloy includes Ni in an amount of at least 95.0 weight percent.

In one embodiment, the Ni alloy includes Ni in an amount less than 99.99 weight percent. In another embodiment, the Ni alloy includes Ni in an amount less than 98.3 weight percent. In yet another embodiment, the Ni alloy includes Ni in an amount less than 95.0 weight percent.

As stated above, the Ni alloy includes at least one of a Group 3 element, a Group 4 element, a Group 13 element, chromium (Cr), silicon (Si), and manganese (Mn) in a total amount sufficient to affect the strength of the Ni alloy. The Group 3 elements, Group 4 elements, Group 13 elements, as well as the Si, Cr, and Mn strengthen the Ni alloy and thus enhance oxidation resistance of the Ni alloy. In one embodiment, Ni alloy includes at least one of a Group 3 element, a Group 4 element, a Group 13 element, chromium (Cr), silicon (Si), and manganese (Mn) in a total amount of 0.01 weight percent to 10.0 weight percent. In another embodiment, Ni alloy includes at least one of a Group 3 element, a Group 4 element, a Group 13 element, chromium (Cr), silicon (Si), and manganese (Mn) in a total amount of 0.5 weight percent to 7.0 weight percent. In yet another embodiment, Ni alloy includes at least one of a Group 3 element, a Group 4 element, a Group 13 element, chromium (Cr), silicon (Si), and manganese (Mn) in a total amount of 1.0 weight percent to 6.4 weight percent. The weight percent of the Group 3 elements, Group 4 elements, Group 13 elements, chromium (Cr), silicon (Si), and manganese (Mn) of the Ni alloy is determined by adding the masses of each and dividing the sum by the total mass of the Ni alloy. The presence and amount of the Group 3 elements, Group 4 elements, Group 13 elements, chromium (Cr), silicon (Si), and manganese (Mn) of the Ni alloy may be detected by a chemical analysis or by viewing an Energy Dispersive Spectra (E.D.S.) of the clad 28 after heating or sintering. The E.D.S. may be generated by a Scanning Electron Microscopy (S.E.M.) instrument.

In one embodiment, Ni alloy includes at least one of a Group 3 element, a Group 4 element, a Group 13 element, chromium (Cr), silicon (Si), and manganese (Mn) in a total amount of at least 0.06 weight percent. In another embodiment, the Ni alloy includes at least one of a Group 3 element, a Group 4 element, a Group 13 element, chromium (Cr), silicon (Si), and manganese (Mn) in a total amount of at least 1.0 weight percent. In yet another embodiment, Ni alloy includes at least one of a Group 3 element, a Group 4 element, a Group 13 element, chromium (Cr), silicon (Si), and manganese (Mn) in a total amount of at least 2.5 weight percent.

In one embodiment, Ni alloy includes at least one of a Group 3 element, a Group 4 element, a Group 13 element, chromium (Cr), silicon (Si), and manganese (Mn) in a total amount less than 10.0 weight percent. In another embodiment, the Ni alloy includes at least one of a Group 3 element, a Group 4 element, a Group 13 element, chromium (Cr), silicon (Si), and manganese (Mn) in a total amount less than 9.1 weight percent. In yet another embodiment, Ni alloy includes at least one of a Group 3 element, a Group 4 element, a Group 13 element, chromium (Cr), silicon (Si), and manganese (Mn) in a total amount less than 5.4 weight percent.

The Group 3 elements are the elements of Group 3 of the periodic table of the elements, including scandium (Sc) yttrium (Y), and lanthanum (La). In one embodiment, the Ni alloy includes Y. The Group 4 elements are the elements of Group 4 of the periodic table of the elements, including titanium (Ti), zirconium (Zr), hafnium (Hf), and rutherfordium (Rf). In one embodiment, the Ni alloy includes Ti. The Group 13 elements are the elements of Group 13 of the periodic table of the elements, including boron (B), aluminum (Al), gallium (Ga), indium (In), and thallium (Tl). In one embodiment, the Ni alloy includes Al.

The method of forming the spark plug 20 includes providing a first powder metal material including Cu and at least one of Zr and Cr and heating the first powder metal material to provide a Cu alloy including, in weight percent of the Cu alloy, Cu in an amount of at least 98.50 weight percent and at least one of Zr and Cr in an amount sufficient to affect the strength of the Cu alloy. In one embodiment, the method includes heating the first powder metal material to a temperature of at least 500° C. so that the Zr and Cr precipitate from the Cu matrix. The method typically includes forming the Cu alloy into a core 26 having a cylindrical shape, such as by pressing and sintering.

Next, the method includes providing a second powder metal material including Ni and at least one of a Group 3 element, a Group 4 element, a Group 13 element, chromium (Cr), silicon (Si), and manganese (Mn), and heating the second powder metal material to provide a Ni alloy including, in weight percent of the Ni alloy, Ni in an amount of at least 90.0 weight percent and at least one of a Group 3 element, a Group 4 element, a Group 13 element, chromium (Cr), silicon (Si), and manganese (Mn) in a total amount sufficient to affect the strength of the Ni alloy. The method also typically includes forming the Ni alloy into a clad 28 covering the core 26, such as by pressing and sintering.

As alluded to above, the core 26 formed of the Cu alloy and clad 28 formed of the Ni alloy provide the center electrode 24 and ground electrode 22 of the spark plug 20. A representative center electrode 24 for use in a spark plug 20 is shown in FIG. 3. A representative ground electrode 22 for use in the spark plug 20 is shown in FIG. 4. The electrodes 22, 24 each include the core 26 formed of the Cu alloy and the clad 28 formed of the Ni alloy. The core 26 typically includes a cylindrical shape, but can include other shapes. The clad 28 typically includes a cylindrical, hollow shape, covering and enrobing the entire core 26. However, the clad 28 can include other shapes and can cover less than the entire core 26.

The electrodes 22, 24 also each include a base 30, typically attached to or part of an end of the clad 28, as shown in FIGS. 3 and 4. The base 30 is typically formed of a base 30 Ni alloy. The base 30 Ni alloy can be the same as or different from the Ni alloy of the clad 28. Each of the electrodes 22, 24 may also include a sparking end 32 disposed on and extending transversely from the base 30, as shown in FIGS. 3 and 4. The sparking end 32 may be a tip, pad, disk, sphere, rivet, or other shaped portion. The sparking end 32 is typically formed of a precious metal or precious metal alloy. The sparking end 32 may be bonded, welded or otherwise attached to the base 30 of the electrode. The sparking ends 32 of the electrodes 22, 24 are located proximate one another and define a spark gap 34 therebetween. The spark plugs 20 ignite gases in an engine cylinder by emitting an electrical spark jumping the spark gap 34 between the center electrode 24 and ground electrode 22.

In one embodiment, both the center electrode 24 and ground electrode 22 include the core 26 formed of the Cu alloy and the clad 28 formed of the Ni alloy. In another embodiment, only the center electrode 24 includes the core 26 formed of the Cu alloy and the clad 28 formed of the Ni alloy. In yet another embodiment, only the ground electrode 22 includes the core 26 formed of the Cu alloy and the clad 28 formed of the Ni alloy.

As stated above, the representative spark plug 20 including the Cu core 26 and Ni clad 28 is shown in FIG. 1. The spark plug 20 is used to ignite a mixture of fuel and air in an internal combustion engine. The representative spark plug 20 comprises a ceramic insulator 36, a metallic shell 38, a center electrode 24, and a ground electrode 22. The ceramic insulator 36 is generally annular and supportably placed inside the metallic shell 38 so that the metallic shell 38 surrounds a portion of the ceramic insulator 36. The center electrode 24 is placed within an axial bore of the ceramic insulator 36. The ground electrode 22 is fixedly welded to a front end surface of the metallic shell 38.

EXAMPLES

Table 2 includes several example embodiments of the Cu alloy of the core 26 of the present invention and a comparative, prior art example of a Cu alloy used in an electrode of the prior art.

TABLE 2

| Copper Core | | | |
|---|---|---|---|
| | Cu (weight percent, wt %) | Zr (weight percent) | Cr (weight percent) |
| Inventive Example 1 | 98.81-99.05 | 0.05-0.15 | 0.0 |
| Inventive Example 2 | 98.81-99.95 | 0.05-0.09 | 0.9-1.10 |
| Prior Art Example 1 | 100.0 | 0.0 | 0.0 |

Table 3 includes three example embodiments of the Ni alloy of the clad 28 of the present invention and a comparative, prior art example of a Ni alloy used in an electrode of the prior art. In another embodiment, Inventive Example 5 may include at least one of Y in an amount of 0.01 weight percent to 0.1 weight percent, Zr in an amount of 0.01 weight percent to 0.2 weight percent and, Ti in an amount of 0.05 weight percent to 0.4 weight percent, and a balance of Ni. In other words, the Y, Zr, Ti may all be present in the Ni alloy, or less than all may be present in the Ni alloy.

TABLE 3

| Ni Clad | | | | | | | | | |
|---|---|---|---|---|---|---|---|---|---|
| | Ni (wt %) | Al (wt %) | Si (wt %) | Y (wt %) | Cr (wt %) | Mn (wt %) | Ti (wt %) | Zr (wt %) | Fe (wt %) |
| Inventive Example 3 | 96.8-97.9 | 1.0-1.5 | 1.0-1.5 | 0.1-0.2 | 0.0 | 0.0 | 0.0 | 0.0 | 0.0 |
| Inventive Example 4 | 94.85-95.9 | 0.0 | 0.35-0.55 | 0.0 | 1.65-1.90 | 1.8-2.1 | 0.2-0.4 | 0.1-0.2 | 0.0 |
| Inventive Example 5 | 91.30-99.69 | 0.1-2.0 | 0.1-2.0 | 0.01-0.1 | 0.1-2.0 | 0.1-2.0 | 0.05-0.4 | 0.01-0.2 | 0.0 |
| Prior Art Example 2 | 75.5-78.1 | 0.0 | 0.2-0.5 | 0.0 | 14.5-15.5 | 0.2-0.5 | 0.0 | 0.0 | 7.0-8.0 |

Example inventive electrodes 22, 24 may include the core 26 formed of the Cu alloy of either Inventive Example 1 or Inventive Example 2. The electrode including the core 26 formed of the Cu alloy of Inventive Example 1 can include the clad 28 formed of the Ni alloy of Inventive Example 3, Inventive Example 4, or Inventive Example 5. Likewise, the electrode including the core 26 formed of the Cu alloy of Inventive Example 2 can include the clad 28 formed of the Ni alloy of Inventive Example 3 or Inventive Example 4. In one embodiment, the electrode includes the core 26 formed of the Cu alloy of Inventive Example 1 and the clad 28 formed of the Ni alloy of Inventive Example 3. In another embodiment, the electrode includes the core 26 formed of the Cu alloy of Inventive Example 2 and the clad 28 formed of the Ni alloy of Inventive Example 4.

Experiment

Performance tests were conducted for two inventive example spark plugs 20 and a comparative example spark plug 20. The first inventive example spark plug 20 comprised an electrode including the core 26 formed of the Cu alloy of Inventive Example 1 and the clad 28 formed of the Ni alloy of Inventive Example 3. The second inventive example spark plug 20 comprised an electrode including the core 26 formed of the Cu alloy of Inventive Example 2 and the clad 28 formed of the Ni alloy of Inventive Example 4. The comparative example spark plug comprised an electrode including the core formed of the Cu alloy of the Prior Art Example 1 and the clad formed of the Ni alloy of the Prior Art Example 2.

The thermal conductivity of the electrodes 22, 24 of the spark plugs 20 were tested at room temperature. For the first inventive example spark plug 20, the thermal conductivity of the Cu alloy of the electrode was 360.0 W/mK at room temperature, and the thermal conductivity of the Ni alloy of the electrode was 36.8 W/mK at room temperature. For the second inventive example spark plug 20, the thermal conductivity of the Cu alloy of the electrode was 323.4 W/mK at room temperature and the thermal conductivity of the Ni alloy of the electrode was 26.3 W/mK at room temperature. For the comparative example spark plug 20, the thermal conductivity of the Cu alloy of the electrode was 401.0 W/mK and the thermal conductivity of the Ni alloy of the electrode was 14.8 W/mK.

The test results indicate the electrodes 22, 24 of the inventive example spark plugs 20 maintain a thermal conductivity similar to the electrodes of the prior art spark plugs and thus sufficiently limit the spark plug 20 operating temperature and resist erosion during operating of the spark plug 20 in an internal combustion engine at temperature of at least 500° C.

Figure 7:
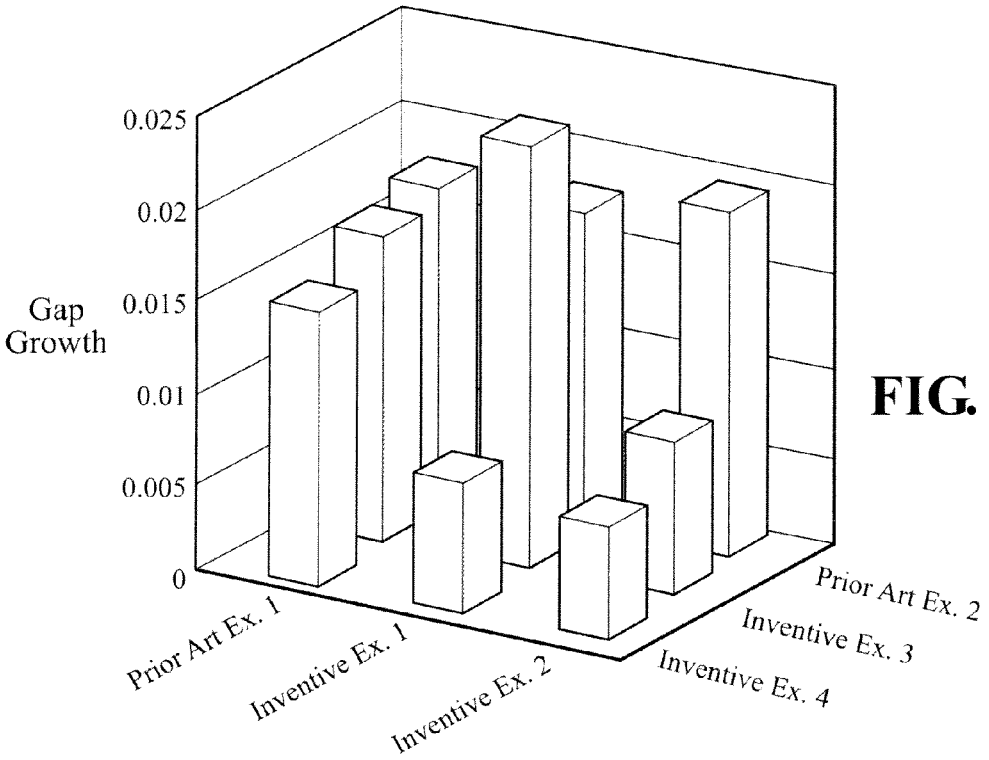
FIG. 7 is a graph illustrating the increase in sparking gap width for several examples embodiments of the invention and comparative examples.

The sparking gap growth of the examples spark plugs 20 was also tested in a gasoline engine for 500 hours. The sparking gap growth is the amount, measured in inches, that the sparking gap increases under operating conditions of the spark plug 20 in a gasoline engine for 500 hours A graphical display of the sparking gap growth test results are shown in FIG. 7. The test results indicate the combination of the Cu alloy and Ni alloy of the inventive example spark plugs 20 provide a less sparking gap growth than the comparative example spark plug of the prior art. Thus, the test results indicate the inventive example spark plugs 20 provide an improved performance during operation of the spark plugs 20 in an internal combustion engine compared to spark plugs of the prior art.

The swelling percent (ΔS) of electrodes of the example spark plugs 20 were also measured after an engine test for 500 hours. The swelling percent is the percentage of decrease in length of a portion of the electrode over the 500 hour engine test. For each electrode tested, several parameters, including initial length of the electrode, were recorded before loading the spark plugs into the engine test. FIG. 9 illustrates the initial length of an example electrode measured. After the engine test for 500 hours, the tested spark plugs were dissembled and the final length of the electrode was measured. The swelling percent was obtained for each example according to the following formula:

$$\Delta S=(L_{final}-L_0)/L_0$$

where $L_0$ is the length of the electrode before the 500 hour engine test, $L_{final}$ is the length of the electrode after the 500 hour engine test, and ΔS is the swelling percent of the electrode during the 500 hour engine test.

Figure 8:
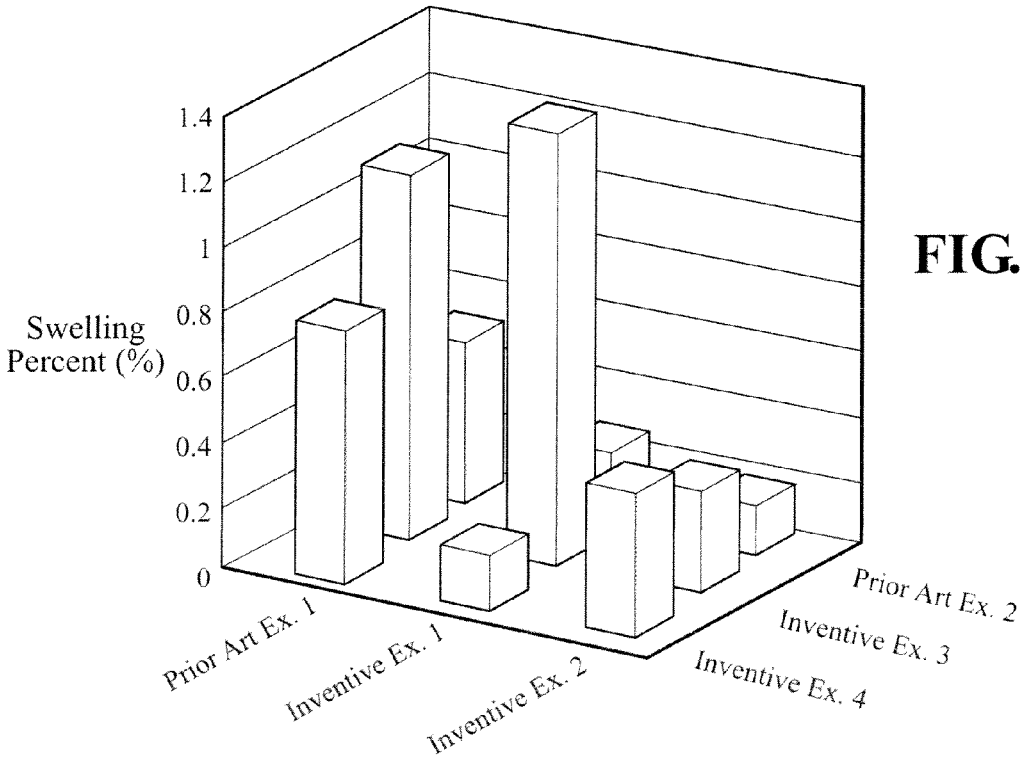
FIG. 8 is a graph illustrating the swelling percent for several examples embodiments of the invention and comparative examples.

A graphical display of the swelling rate test results are shown in FIG. 8. The test results indicate the electrodes 22, 24 of the inventive example spark plugs 20 provide a lower swelling rate and thus a higher creep resistance than the electrodes of the prior art spark plugs. Thus, the test results indicate the inventive example spark plugs 20 provide an improved performance during operation of the spark plugs 20 in an internal combustion engine compared to spark plugs of the prior art.

Obviously, many modifications and variations of the present invention are possible in light of the above teachings and may be practiced otherwise than as specifically described while within the scope of the appended claims. The reference numerals in the claims are merely for convenience and are not to be read in any way as limiting.

The invention claimed is:

1. A method of forming an electrode for use in a spark plug, comprising the steps of:

providing a core formed of a Cu alloy, the Cu alloy including, in weight percent of the Cu alloy: Cu in an amount of at least 98.50 weight percent, and at least one of Zr and Cr in a total amount of at least 0.05 weight percent;

providing a Ni alloy including, in weight percent of the Ni alloy: Ni in an amount of at least 90.0 weight percent; at least one of a Group 3 element, a Group 4 element, and a Group 13 element; and at least one of chromium (Cr), silicon (Si), and manganese (Mn); and forming the Ni alloy into a clad (28) covering the core (26).

2. The method of claim 1, wherein the step of providing the core includes providing the Cu alloy as a powder; pressing the Cu alloy powder; and heating the Cu alloy powder.

3. The method of claim 2, wherein the step of forming the Ni alloy into the clad includes providing the Ni alloy as a powder; pressing the Ni alloy powder onto the core; and heating the Ni alloy powder.

4. The method of claim 3, wherein the heating step includes sintering.

5. The method of claim 1, wherein the Cu alloy includes, in weight percent of the Cu alloy, the at least one of Zr and Cr in a total amount of at least 0.05 weight percent.

6. The method of claim 1, wherein the Cu alloy includes a matrix of the Cu and precipitates of the at least one of Zr and Cu dispersed in the Cu matrix.

7. The method of claim 1, wherein the Cu alloy includes Cu in an amount up to 99.95 weight percent, and the at least one of Zr and Cr in an amount up to 1.5 weight percent.

8. The method of claim 1, wherein the Cu alloy includes at least one of tellurium (Te), selenium (Se), iron (Fe), silver (Ag), boron (B), beryllium (Be), phosphorous (P), titanium (Ti), and sulfur (S) in a total amount of 0.01 to 1.45 weight percent.

9. The method of claim 8, wherein the Cu of the Cu alloy is a matrix and the at least one of tellurium (Te), selenium (Se), iron (Fe), silver (Ag), boron (B), beryllium (Be), phosphorous (P), titanium (Ti), and sulfur (S) are precipitates dispersed in the Cu matrix.

10. The method of claim 1, wherein the Cu alloy includes Cu in an amount of 98.81 weight percent to 99.05 weight percent and Zr in an amount of 0.05 weight percent to 0.15 weight percent.

11. The method of claim 1, wherein the Cu alloy includes Cu in an amount of 99.81 weight percent to 99.95 weight percent, Zr in an amount of 0.05 weight percent to 0.09 weight percent, and Cr in an amount of 0.9 weight percent to 1.10 weight percent.

12. The method of claim 1, wherein the Ni alloy includes the at least one Group 3 elements, Group 4 element, and Group 13 element; and the at least one chromium (Cr), silicon (Si), and manganese (Mn) in a total amount of 1.0 weight percent to 10.0 weight percent.

13. The method of claim 1, wherein the Ni alloy includes the at least one Group 3 element in an amount of 0.01 weight percent to 0.2 weight percent.

14. The method of claim 1, wherein the Ni alloy includes the at least one Group 4 element in an amount of 0.01 weight percent to 0.5 weight percent.

15. The method of claim 1, wherein the at least one Group 13 element includes Al.

16. The method of claim 1, wherein the Ni alloy includes Ni in an amount of 96.8 weight percent to 97.9 weight percent, Al in an amount of 1.0 weight percent to 1.5 weight percent, Si in an amount of 1.0 weight percent to 1.5 weight percent, and Y in an amount of 0.01 weight percent to 0.2 weight percent.

17. The method of claim 1, wherein the Ni alloy includes Ni in an amount of 94.85 weight percent to 95.9 weight percent, Cr in an amount of 1.65 weight percent to 1.90 weight percent, Mn in an amount of 1.8 weight percent to 2.1 weight percent, Si in an amount of 0.35 weight percent to 0.55 weight percent, Ti in an amount of 0.2 weight percent to 0.4 weight percent, and Zr in an amount of 0.1 weight percent to 0.2 weight percent.

18. The method of claim 1, wherein the Ni alloy includes Ni in an amount of 91.30 weight percent to 99.69 weight percent; Al in an amount of 0.1 weight percent to 2.0 weight percent; Si in an amount of 0.1 weight percent to 2.0 weight percent; Cr in an amount of 0.1 weight percent to 2.0 weight percent; Mn in an amount of 0.1 weight percent to 2.0 weight percent; and at least one of Y in an amount of 0.01 weight percent to 0.1 weight percent, Zr in an amount of 0.01 weight percent to 0.2 weight percent and, Ti in an amount of 0.05 weight percent to 0.4 weight percent.

19. A method of forming a spark plug having at least one electrode, comprising the steps of:

providing a core formed of a Cu alloy, the Cu alloy including, in weight percent of the Cu alloy: Cu in an amount of at least 98.50 weight percent, and at least one of Zr and Cr in a total amount of at least 0.05 weight percent;

providing a Ni alloy including, in weight percent of the Ni alloy: Ni in an amount of at least 90.0 weight percent; at least one of a Group 3 element, a Group 4 element, and a Group 13 element; and at least one of chromium (Cr), silicon (Si), and manganese (Mn); and forming the Ni alloy into a clad (28) covering the core (26).

* * * * *